US008657052B2

(12) United States Patent
Sakatani

(10) Patent No.: US 8,657,052 B2
(45) Date of Patent: Feb. 25, 2014

(54) UPPER MACHINE BODY FOR OPERATING MACHINE, AND OPERATING MACHINE HAVING THE SAME

(71) Applicant: Kobelco Construction Machinery Co., Ltd., Hiroshima (JP)

(72) Inventor: Masanori Sakatani, Hiroshima (JP)

(73) Assignee: Kobelco Construction Machinery Co., Ltd., Hiroshima-shi (JP)

( * ) Notice: Subject to any disclaimer, the term of this patent is extended or adjusted under 35 U.S.C. 154(b) by 0 days.

(21) Appl. No.: 13/650,568

(22) Filed: Oct. 12, 2012

(65) Prior Publication Data

US 2013/0092858 A1 Apr. 18, 2013

(30) Foreign Application Priority Data

Oct. 17, 2011 (JP) ..... 2011-227609

(51) Int. Cl.
*B62D 25/20* (2006.01)
*F16K 31/46* (2006.01)

(52) U.S. Cl.
USPC ..... 180/90.6; 74/512; 251/295; 296/193.07

(58) Field of Classification Search
USPC ..... 180/89.1, 90.6; 280/294; 296/193.07; 74/512; 251/231, 295
See application file for complete search history.

(56) References Cited

U.S. PATENT DOCUMENTS

2009/0293666 A1* 12/2009 Kim et al. ..... 74/513

FOREIGN PATENT DOCUMENTS

JP 2005-264538 9/2005

* cited by examiner

*Primary Examiner* — Paul N Dickson
*Assistant Examiner* — Timothy Wilhelm
(74) *Attorney, Agent, or Firm* — Oblon, Spivak, McClelland, Maier & Neustadt, L.L.P.

(57) ABSTRACT

A floor panel is formed with an opening for mounting a pedal device. The opening permits a remote control valve to penetrate through the floor panel. The opening has an insertion region configured to allow the joint, the hydraulic hose and a lower portion of a valve body to be inserted thereinto from above the floor panel, and an arrangement region located in side-by-side relation to the insertion region in a second direction and configured to allow the valve body to be arranged therein while being fixed to the floor panel. In top plan view, a length of the opening in the second direction is less than a length of the opening in the first direction, and a length of the arrangement region in the first direction is less than a length of the insertion region in the first direction.

8 Claims, 7 Drawing Sheets

UPPER MACHINE BODY FOR OPERATING MACHINE, AND OPERATING MACHINE HAVING THE SAME

BACKGROUND OF THE INVENTION

1. Field of the Invention

The present invention relates to an operating machine comprising an attachment and a pedal device for manipulating the attachment, wherein the operating machine includes a recycling machine and a construction machine. In particular, the present invention relates to an installation structure for the pedal device.

2. Description of the Background Art

Heretofore, there has been known an operating machine equipped with a pedal device for manipulating an attachment. Generally, the pedal device comprises a remote control valve, a pedal mounted to an upper portion of the remote control valve, a joint extending from a lower portion of the remote control valve, and a hydraulic hose connected to the joint. The pedal device is handled as one component, i.e., under a condition that the remote control valve, the pedal, the joint and the hydraulic hose are assembled together. The pedal device is installed to a floor panel constructing a floor surface of an operator's room.

The remote control valve is mounted to the floor panel while penetrating through the floor panel via an opening formed in the floor panel. Specifically, the remote control valve is mounted to the floor panel in a posture where the pedal is located above the floor surface, and the hydraulic hose is located below the floor surface.

As this type of pedal device, for example, JP 2005-264538A (hereinafter referred to as "Patent Document 1") discloses a construction machine having a pedal device mounted to a floor panel in such a manner as to be adjustable in terms of a mounting position thereof.

Specifically, in the construction machine disclosed in the Patent Document 1, a floor panel is formed with a relatively large quadrate-shaped control valve mounting hole which is laterally longer than a lateral width of a remoter control valve. This allows the mounting position of the pedal device inserted into the control valve mounting hole to be selectively changed toward one of right and left ends (opposite lateral ends) of the control valve mounting hole.

In addition to the remoter control valve, the Patent Document 1 also discloses a cover plate for covering the control valve mounting hole.

Meanwhile, a mounting operation for the pedal device is performed on a side above the floor panel where it is possible to ensure a wider operation space as compared to a side below the floor panel. Specifically, a lower portion of the remoter control valve is inserted into the control valve mounting hole from thereabove, together with a joint and a hydraulic hose, and then the remoter control valve is mounted to the floor panel. Therefore, the floor panel is formed with an opening having a size greater than that required for mounting only the remoter control valve.

In the construction machine disclosed in the Patent Document 1, in order to provide adjustability of the mounting position of the pedal device, the floor panel is formed with an opening larger than an opening required for installing the pedal device to the floor panel.

However, along with an increase in opening area of the floor panel, strength and rigidity of the floor panel will be deteriorated.

SUMMARY OF THE INVENTION

It is an object of the present invention to provide an upper machine body for an operating machine, capable of suppressing deterioration in strength and rigidity of a floor panel while maintaining efficiency of a mounting operation for a pedal device, and an operating machine having the upper machine body.

In order to achieve the above object, the present invention provides an upper machine body to be provided on a lower propelling body of an operating machine. The upper machine body comprises: an attachment; a hydraulic actuator for driving the attachment by supply and drainage of hydraulic oil thereto and therefrom; a pedal device including a remote control valve for controlling the supply and drainage of hydraulic oil to and from the hydraulic actuator, a pedal and a joint each provided to the remote control valve, and a hydraulic hose connected to the joint; and a floor panel to which the pedal device is mounted, the floor panel being formed with an opening for permitting the remote control valve to penetrate through the floor panel in a posture where the pedal is disposed above the floor panel, and the joint and the hydraulic hose are disposed below the floor panel. The remote control valve has a valve body with a cross-sectional shape in which a length in a first direction is greater than a length in a second direction perpendicular to the first direction, in top plan view, and the joint has a portion extending in the first direction and outwardly with respect to the valve body, in top plan view. The opening of the floor panel has an insertion region configured to allow the joint, the hydraulic hose and a lower portion of the valve body to be inserted thereinto from above the floor panel, and an arrangement region located in side-by-side relation to the insertion region in the second direction and configured to allow the valve body to be arranged therein while being fixed to the floor panel. Further, in top plan view, a length of the opening in the second direction is less than a length of the opening in the first direction, and a length of the arrangement region in the first direction is less than a length of the insertion region in the first direction.

The present invention also provides an operating machine which comprises a self-propelled lower propelling body, and the above upper machine body provided on the lower propelling body.

The present invention can suppress deterioration in strength and rigidity of the floor panel while maintaining efficiency of a mounting operation for the pedal device.

DETAILED DESCRIPTION OF THE PREFERRED EMBODIMENTS OF THE INVENTION

With reference to the accompanying drawings, an embodiment of the present invention will now be described. It is to be understood that the following embodiment is a specific example of the present invention, but it is not intended to limit the present invention thereto.

Figure 1:
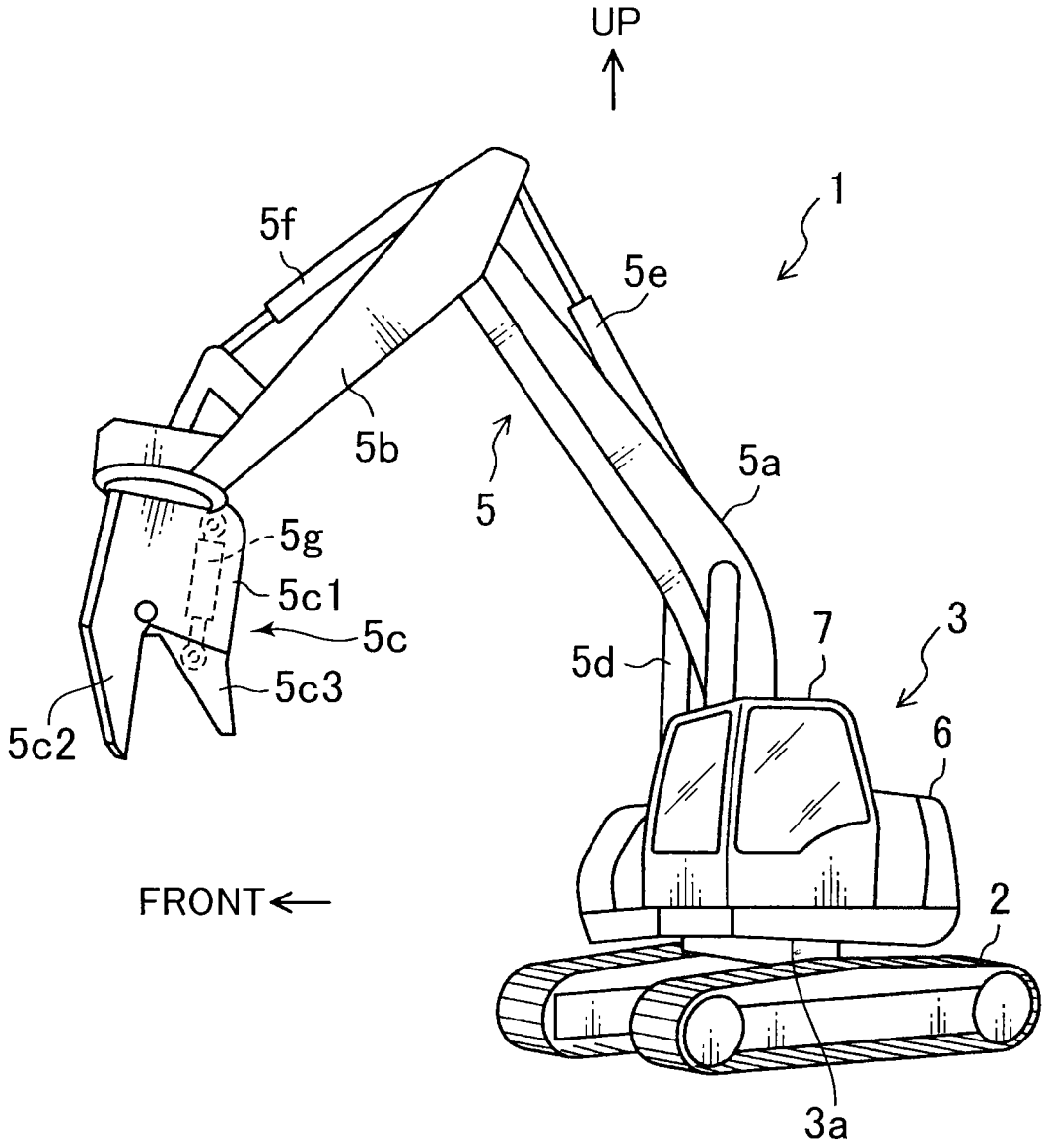
FIG. 1 is a schematic diagram illustrating an entire configuration of an operating machine according to one embodiment of the present invention.

FIG. 1 is a schematic diagram illustrating an entire configuration of an operating machine 1 according to one embodiment of the present invention. The operating machine 1 according to this embodiment is one type of recycling machine for use in dismantling of scrap metals, etc. Specifically, the operating machine 1 comprises a crawler-type lower propelling body 2, and a machine body 3 slewably provided on the lower propelling body 2. The following description will be made using a front-rear direction and a right-left direction, which are based on an operator seated in an aftermentioned seat 11.

The machine body 3 comprises an upper frame 3*a* slewably provided on the lower propelling body 2, and a working implement 5, a machine room cover 6 and a cabin 7 each provided on the upper frame 3*a*.

The working implement 5 comprises a boom 5*a* having a base end raisably and lowerably mounted to a front portion of the upper frame 3*a*, an arm 5*b* having a base end swingably mounted to an distal end of the boom 5*a*, and a crusher (one example of an attachment) 5*c* swingably attached to a distal end of the arm 5*b*. The crusher 5*c* comprises a crusher body 5*c*1 swingably mounted to the distal end of the arm 5*b*, a stationary knife 5*c*2 fixed to the crusher body 5*c*1, and a turnable knife 5*c*3 mounted to the crusher body 5*c*1 in a manner movable closer to and away from the stationary knife 5*c*2.

The working implement 5 further comprises a boom cylinder 5*d* for raising and lowering the boom 5*a* with respect to the upper frame 3*a*, an arm cylinder 5*e* for swingably moving the arm 5*b* with respect to the boom 5*a*, a swing cylinder 5*f* for swingably moving the crusher 5*c* with respect to the arm 5*b*, and a turn cylinder (one example of a hydraulic actuator) 5*g* for turning the turnable knife 5*c*3 with respect to the crusher body 5*c*1. The turn cylinder 5*g* is adapted to drive the crusher 5*c* according to supply and drainage of hydraulic oil thereto and therefrom. Specifically, according to extending and retracting movements of the turn cylinder 5*g*, the turnable knife 5*c*3 of the crusher 5*c* is moved between a closed position and an open position.

The machine room cover 6 is provided primarily at a rear end of the machine body 3 (upper frame 3*a*). A machine room is defined inside the machine room cover 6, wherein an engine, hydraulic devices, etc., are installed therein.

Figure 2:
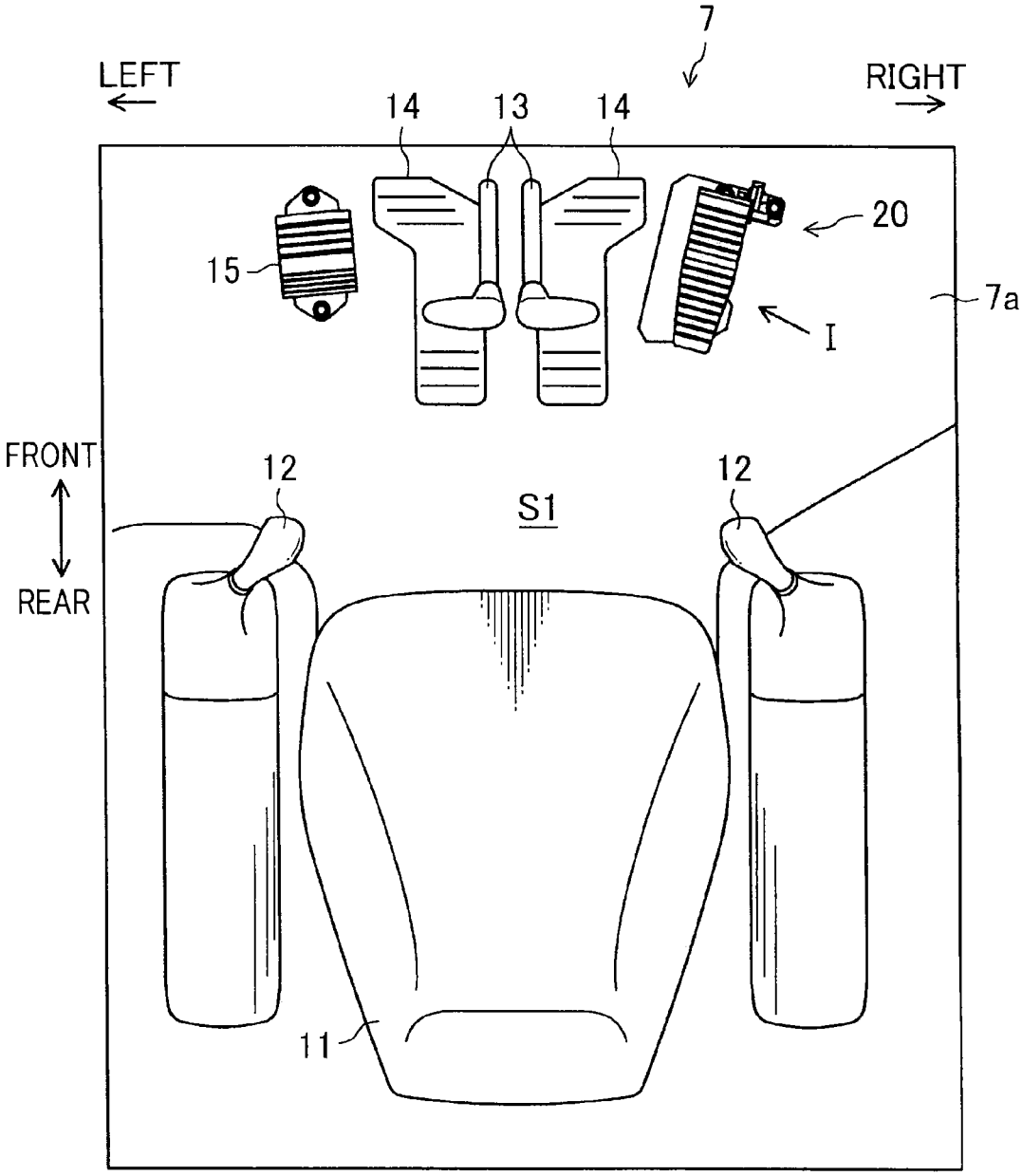
FIG. 2 is a schematic top plan view of an inside of a cabin.

FIG. 2 is a schematic top plan view of an inside of the cabin 7.

Referring to FIGS. 1 and 2, the cabin 7 is provided on the front portion of the machine body 3 in side-by-side relation to the boom 5*a*. The cabin 7 is provided with a panel covering around an operator's room S1, and formed in a rectangular box shape. Specifically, the cabin 7 comprises a floor panel 7*a* forming a floor surface of the operator's room S1, and a seat 11, a pair of first manipulation levers 12, a pair of second manipulation levers 13, a pair of propelling pedals 14, a foot rest 15 and a manipulation pedal section 20 which are mounted to the floor panel 7*a*.

The seat 11 is designed to allow an operator to be seated therein. The seat 11 is installed in a rear region of the operator's room S1.

Each of the pair of first manipulation levers 12 is designed to input an operating instruction to the working implement 5. The first manipulation levers 12 are provided, respectively, on right and left sides of the seat 11. Although illustration is omitted, various manual operation devices including a switch and a button are installed around each of the first manipulation levers 12.

The pair of right and left second manipulation levers 13, the pair of right and left propelling pedals 14, the foot rest 15 and the manipulation pedal section 20 are installed in a front region of the operator's room S1. Specifically, the second manipulation levers 13 and the propelling pedals 14 are installed in a central region of a front portion of the floor panel 7*a*. The foot rest 15 is installed on a left side of the second manipulation levers 13 and the propelling pedals 14. The manipulation pedal section 20 is provided on a right side of the second manipulation levers 13 and the propelling pedals 14.

Figure 3:
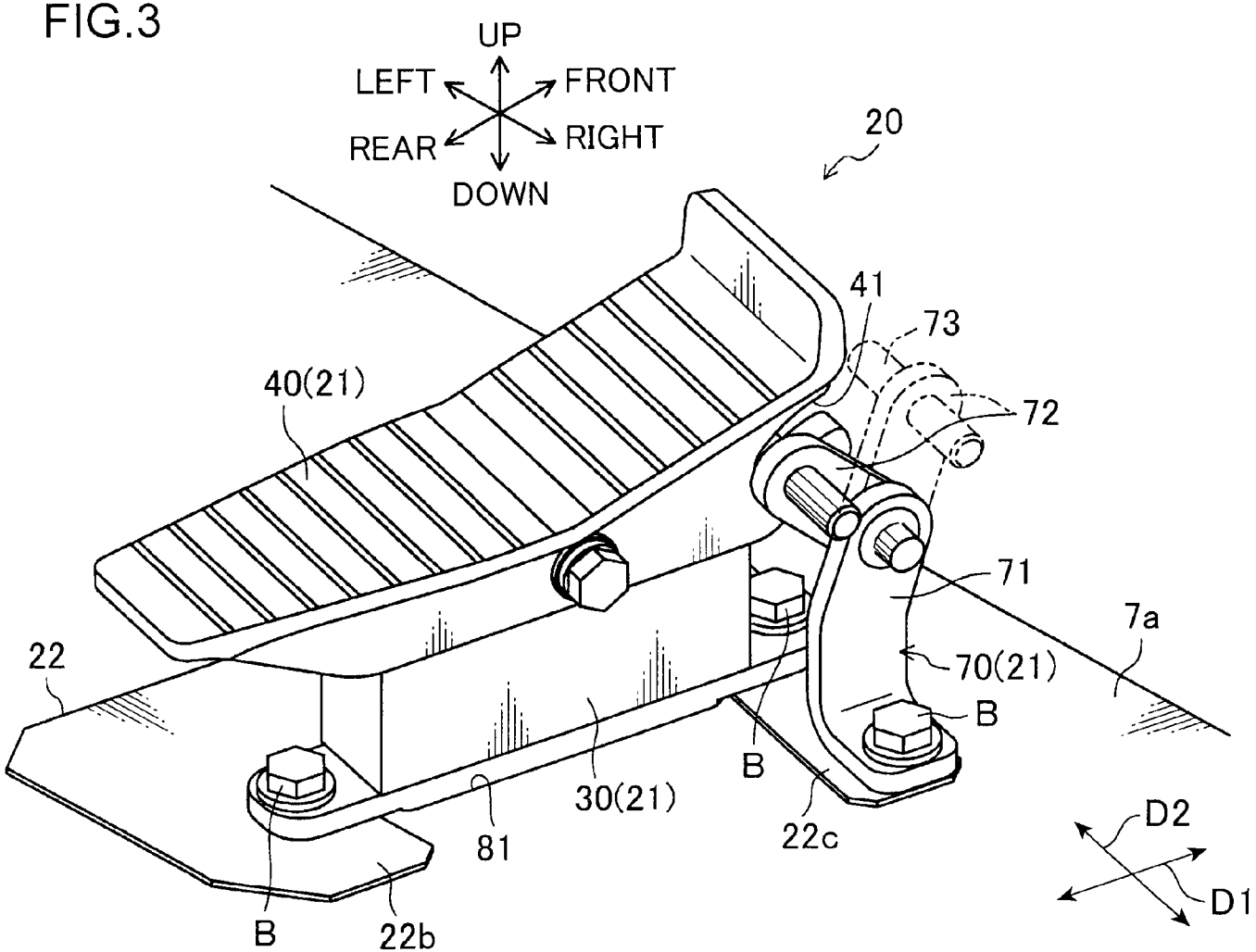
FIG. 3 is a schematic perspective view enlargedly illustrating a part when viewed in a direction indicated by the arrow I in FIG. 2.

FIG. 3 is a perspective view enlargedly illustrating a part of the manipulation pedal section 20 in FIG. 2. The manipulation pedal section 20 is designed to input an operating instruction to the crusher 5*c*. Specifically, the manipulation pedal section 20 comprises a pedal device 21 and a cover 22 each mounted to the floor panel 7*a*. The pedal device 21 will first be described.

Figure 4:
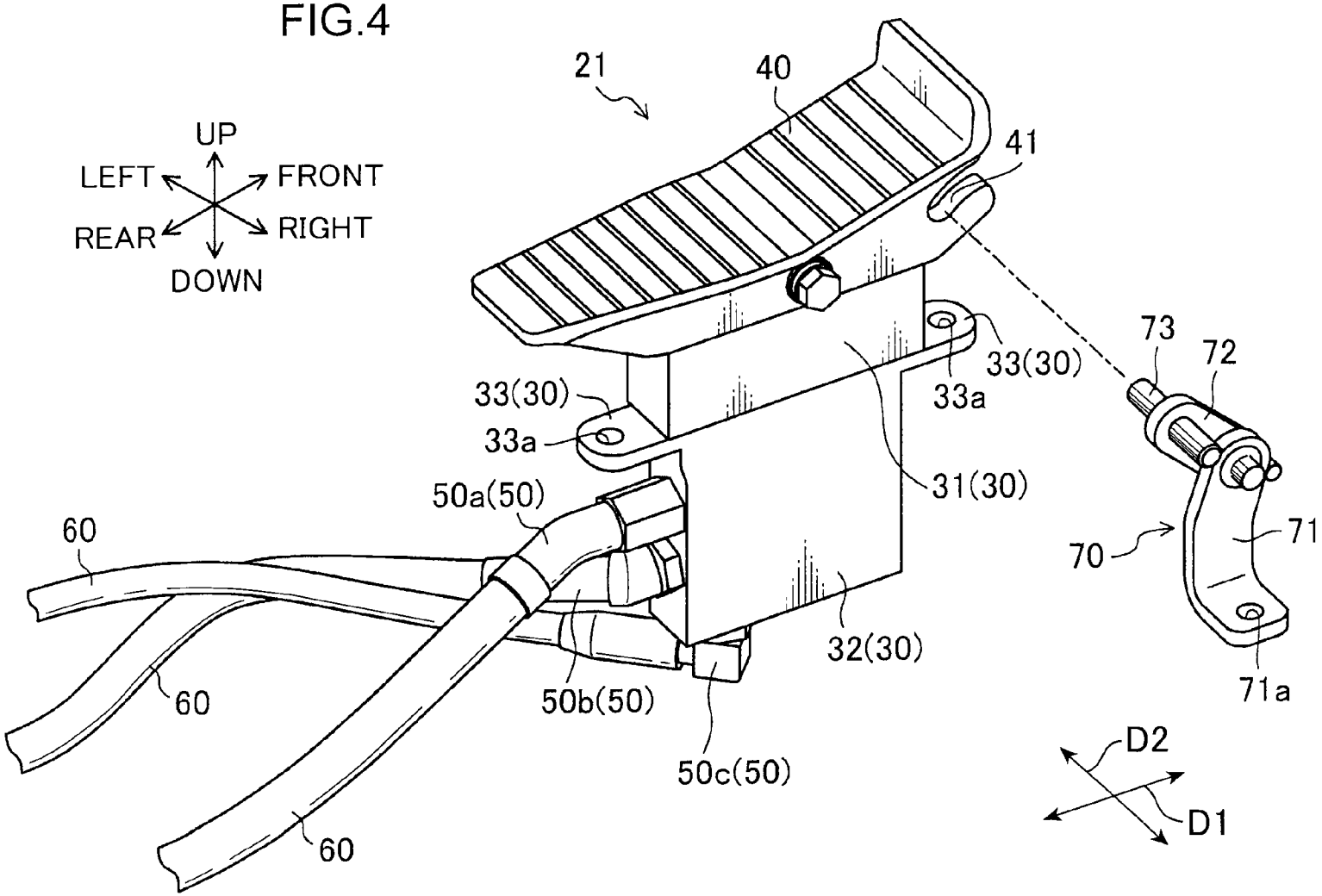
FIG. 4 is a schematic diagram illustrating a pedal device in FIG. 3.

FIG. 4 is a schematic diagram illustrating the pedal device 21.

The pedal device 21 comprises a remote control valve 30 for controlling the supply and drainage of hydraulic oil to and from the turn cylinder 5*g* (see FIG. 1), a pedal 40 and a joint 50 each provided to the remote control valve 30, a hydraulic hose 60 connected to the joint 50, and a stopper 70 engageable with the pedal 40 to preclude operation of the pedal 40. The components of the pedal device 21, except for the stopper 70, are preliminarily assembled into a predetermined state, and handled as one component during installation to the floor panel 7*a*. Details of the stopper 70 will be described later.

Figure 5:
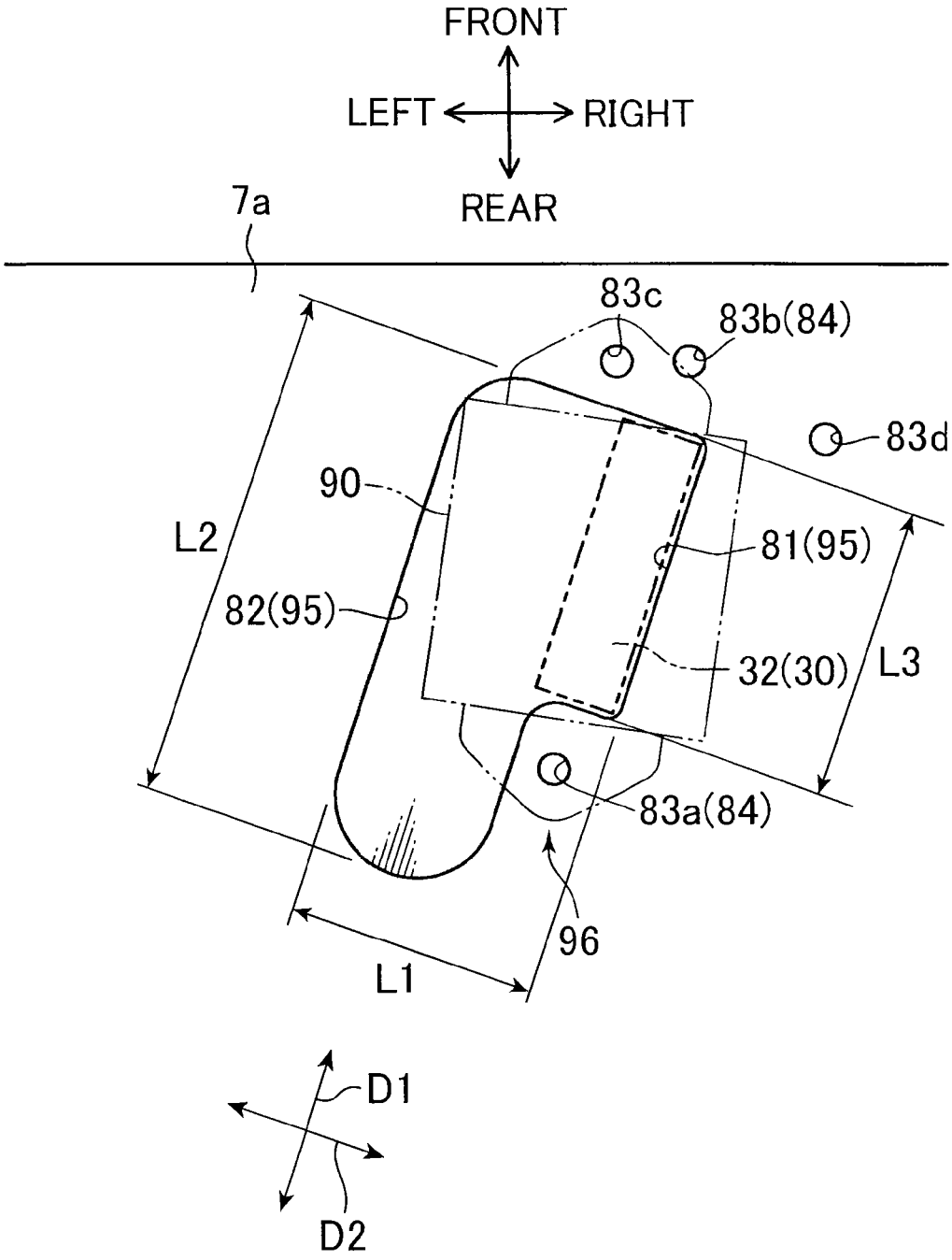
FIG. 5 is a schematic top plan view enlargedly illustrating a mounting portion for the pedal device, in a floor panel.

The remote control valve 30 is a longitudinally-long member having a generally rectangular shape which is long in a front-rear direction. Specifically, the remote control valve 30 has a pedal support portion 31, a valve body 32 connecting to a lower side of the pedal support portion 31, and a pair of flanges 33 each extending laterally from an upper end of the valve body 32. As illustrated in FIG. 5, the valve body 32 has a cross-sectional shape in which a length in a first direction D1 is greater than a length in a second direction D2 perpendicular to the first direction D1, in top plan view. In this embodiment, the first direction D1 is a direction inclining rightwardly toward the front direction. Each of the flanges 33 extends from the valve body 32 in a respective one of opposite directions along the first direction (see FIG. 4). Each of the flanges 33 is formed with a first through-hole 33*a* penetratingly therethrough in an up-down (vertical) direction.

The pedal 40 is pivotally supported with respect to an upper end of the pedal support portion 31 rockingly movably about an axis along the second direction D2 so as to allow a depression operation by an operator. The pedal 40 is a longitudinally-long member in which a length in the first direction D1 is greater than a length in the second direction D2. Specifically, the pedal 40 has an upper surface serving as a depressable surface extending in the first direction D1. An intermediate portion of the pedal 40 in the first direction D1 is pivotally supported by the upper end of the pedal support portion 31. Thus, the pedal 40 can be rockingly moved about an axis along the second direction D2 in such a manner that opposite ends of the pedal 40 in the first direction D1 are alternately moved up and down.

The remote control valve 30 is internally provided with a hydraulic control mechanism (not illustrated) adapted to be operated with the operation of depressing the pedal 40. A plurality of the hydraulic hose 60 are connected to the valve body 32 via respective ones of a plurality of the joints 50 so as to feed hydraulic oil to be controlled by the hydraulic control mechanism (in this embodiment, the number of the hydraulic hose 60 (the joints 50) is three).

The joints 50 protrude from the valve body 32, respectively, in different directions oriented generally rearwardly. Specifically, two 50*a*, 50*b* of the joints 50 are mounted to a rear end surface of the valve body 32 vertically in side-by-side relation. The upper joint 50*a* extends rearward from the rear end surface of the valve body 32 in a manner that the upper joint 50*a* inclines downwardly toward the rear direction. The lower joint 50*b* extends rearward from the rear end surface of the valve body 32 in a manner that the lower joint 50*b* inclines leftwardly toward the rear direction. As above, each of the joints 50*a*, 50*b* entirely extends in the first direction D1 and outwardly (rearwardly) with respect to the valve body 32, in top plan view. The remaining joint 50*c* is provided to a lower end surface of the valve body 32. Specifically, the joint 50*c* is an L-shaped joint extending downwardly from the lower end surface of the valve body 32 and then bending and extending rearwardly. Further, a distal portion of the joint 50*c* extending from the bending position extends rearward in a manner the distal portion of the joint 50*c* inclines leftwardly toward the rear direction. As above, the joint 50*c* has a portion (rear portion) extending in the first direction D1 and outwardly with respect to the valve body 32, in top plan view.

Each of the long hydraulic hoses 60 is connected to a respective one of the joints 50 to provide a connection to a non-illustrated hydraulic device installed inside the machine room cover 6.

As illustrated in FIG. 5, the floor panel 7*a* is formed with an opening 95. The opening 95 is designed to permit the remote control valve 30 to penetrate through the floor panel 7*a* in a posture where the pedal 40 is disposed above the floor panel 7*a*, and the joints 50 and the hydraulic hoses 60 are disposed below the floor panel 7*a*.

Specifically, the opening 95 has an insertion region 82 configured to allow the joints 50, the hydraulic hoses 60 and a lower portion of the valve body 32 to be inserted thereinto from above the floor panel 7*a*, and a arrangement region 81 located in side-by-side relation to the insertion region 82 in the second direction D2 and configured to allow the valve body 32 to be arranged therein while being fixed to the floor panel 7*a*. Further, a length L1 of the opening 95 in the second direction D2 is less than a length L2 of the opening 95 in the first direction D1, and a length L3 of the arrangement region 81 in the first direction D1 is less than a length L2 of the insertion region 82 in the first direction D1.

The arrangement region 81 is a rectangular-shaped opening extending in the first direction D1, in top plan view. The arrangement region 81 has an opening area slightly greater than a horizontal sectional area of the valve body 32.

The insertion region 82 is an approximately rectangular-shaped opening having a size greater than that of the arrangement region 81 and less than that of the pedal 40. The insertion region 82 and the arrangement region 81 are integrated together by coupling a right long side of the insertion region 82 with a left long side of the arrangement region 81. The insertion region 82 has a front short side linearly continuous with a front short side of the arrangement region 81. The insertion region 82 has a rear short side formed in an arc shape. Further, a rear end of the insertion region 82 protrudes rearwardly (in the first direction) with respect to a rear end of the arrangement region 81.

A mounting portion 84 is provided in an edge of the arrangement region 81 of the floor panel 7*a* and is adapted to allow the flanges 33 to be mounted thereto from thereabove in a state in which the valve body 32 is arranged in the arrangement region 81. Specifically, the mounting portion 84 is formed with two internal threads 83*a*, 83*b*. In top plan view, the internal thread 83*a* is provided in a corner portion of the floor panel 7*a* adjacent the insertion region 82 and the arrangement region 81. The internal thread 83*b* is provided on a side opposite to the internal thread 83*a* with respect to the arrangement region 81 in the first direction D1. In other words, the arrangement region 81 is located between the internal threads 83*a*, 83*b* in the first direction D1.

The floor panel 7*a* is further provided with two internal threads 83*c*, 82*d* for mounting the cover 22 thereto as described later.

In this embodiment, the internal threads 83*a* to 83*d* are directly formed in the floor panel 7*a*. However a mechanism for allowing the valve body 32 to mount to the floor panel 7*a* is not limited to the internal threads 83*a* to 83*d*. Alternatively, for example, a configuration may be employed in which a through-hole is formed in the floor panel 7*a*, and a nut disposed in concentric relation to the through-hole is fixed to a lower surface of the floor panel 7*a*.

Figure 6A:
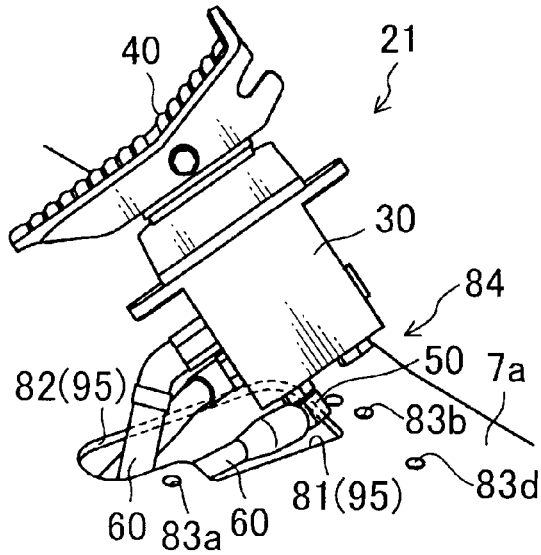
FIGS. 6A, 6B and 6C are schematic diagrams illustrating a state after only a hydraulic hose in the pedal device is inserted into an insertion region, a state before a lower portion of a valve body in the pedal device is inserted into the insertion region, and a state in which the valve body is partially inserted into the insertion portion, respectively.
Figure 6B:
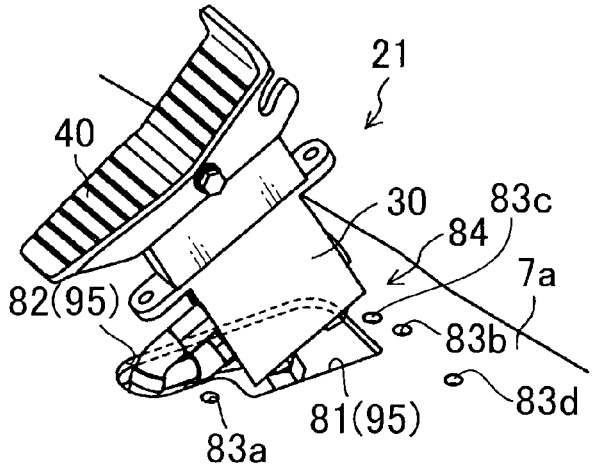
Figure 6C:
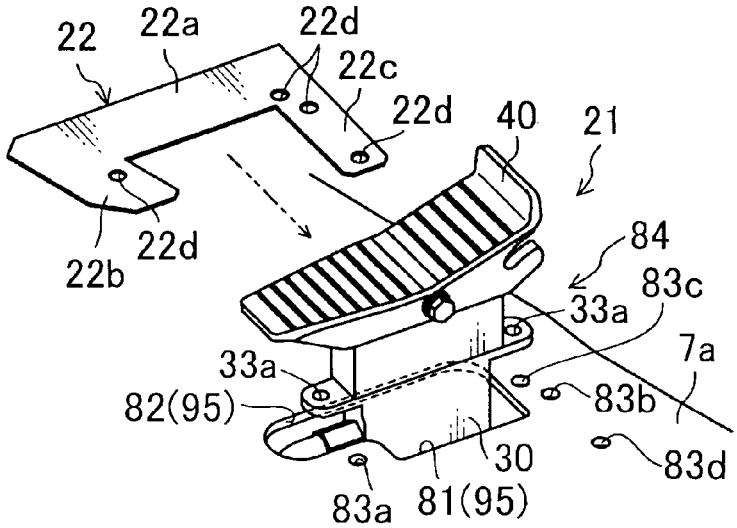

As illustrated in FIGS. 2 and 6C, the cover 22 is mounted to the floor panel 7*a* to close the insertion region 82. The cover 22 is a plate member having a generally angular-C shape in top plan view. Specifically, the cover 22 has a covering portion 22*a* extending in the front-rear direction to close the insertion region 82, a first extension portion 22*b* extending rightwardly from a rear end of the covering portion 22*a*, and a second extension portion 22*c* extending rightwardly from a front end of the covering portion 22*a*. The first extension portion 22*b* has a length less than that of the second extension portion 22*c*. The first extension portion 22*b* and the second extension portion 22*c* are formed with a plurality of second through-holes 22*d*.

The pedal device 21 is mounted to the floor panel 7*a* by utilizing the insertion region 82. Specifically, a lower end of the remote control valve 30 has the plurality of joints 50 protruding from the valve body 32, and the plurality of hydraulic hoses 60 connected to respective ones of the joints 50. Therefore, in order to mount the remote control valve 30 to the floor panel 7*a* from thereabove, it is necessary to form a large opening allowing insertion of the joints 50 and the hydraulic hoses 60.

However, the formation of such a large opening in the floor panel 7*a* is likely to cause deterioration in strength and rigidity of the floor panel 7*a*. Therefore, in the operating machine 1 according to this embodiment, taking into account the structure of the pedal device 21, a shape of the opening is created to allow the pedal device 21 to be inserted thereinto even with a relatively small opening area.

Specifically, in an operation of mounting the pedal device 21 to the floor panel 7*a*, the remote control valve 30, the joints 50 and the hydraulic hoses 60 can be inserted into the opening 95 by inserting the pedal device 21 into the opening 95 (the arrangement region 81 and the insertion region 82) from above the floor panel 7*a*, while inclining the pedal device 21. Then, the pedal device 21 can be fixed to the floor panel 7*a* by screwing a screw bolt B with each of the internal threads 83*a* to 83*d*.

FIGS. 6A to 6C illustrate a process for mounting the pedal device 21 to the floor panel 7*a*. Firstly, as illustrated in FIG. 6A, the hydraulic hoses 60 are inserted into the opening 95. Each of the hydraulic hoses 60 has flexibility, so that it can be easily inserted into the opening 95 in a bent state. Then, the joints 50 and a lower portion of the valve body 32 are inserted into the opening 95 (particularly, the insertion region 82) while tilting the pedal device 21 in the front-rear and right-left directions to align the extending direction of each of the joints 50 with the first direction D1. In other words, the underside joint 50*c*, and the upside joints 50*a*, 50*b* and the lower portion of the valve body 32, are inserted into the opening 95 in this order.

The joints 50 can be easily inserted into the opening 95 by allowing the joints 50 pass through the opening 95 one-by-one from a lower one of the joints 50. Specifically, the hydraulic hoses of the pedal device 21 are inserted into the opening 95. Then, the joints 50 are inserted into the opening 95 one-by-one. In this way, a portion of the valve body 32 located below the flanges 33 can be inserted below the floor panel 7*a*.

Then, as illustrated in FIG. 6B, when most of the hydraulic hoses 60 and the joints 50 are inserted into the opening 95, the valve body 32 located within the insertion region 82 can be moved approximately parallel to the floor plate 7*a* (in the second direction D2). Thus, the valve body 32 can be fitted into the arrangement region 81 by moving the pedal device 21.

In advance of this process, as illustrated in FIG. 6C, the cover 22 is inserted between the pair of flanges 33 and the floor panel 7*a*. The second through-holes 22*d* of the cover 22 are provided at positions overlapping respective ones of the internal threads 83*a* to 83*d* in a state in which the cover 22 is mounted to the floor panel 7*a* in a predetermined mounting position. Further, the first through-holes 33*a* of the flanges 33 of the remote control valve 30 are set to overlap respective ones of the internal threads 83*a*, 83*b* and respective ones of two of the second through-holes 22*d* aligned with the internal threads 83*a*, 83*b*.

Thus, the pedal device 21 and the cover 22 can be mounted to the floor panel 7*a* by screwing a screw bolt B (fastening member) with each of the internal threads 83*a*, 83*b* vertically overlapping corresponding ones of the first through-holes 33*a* and the second through-holes 22*d*. In other words, the pedal device 21 is demountably mounted to the floor panel 7*a* by a bolts B.

The stopper 70 is designed to inoperably lock the pedal, for example in case where the pedal device 21 is used as a footrest. Specifically, as illustrated in FIGS. 3 and 4, the stopper 70 comprises a support piece 71 to be mounted to the floor panel 7*a*, and a swing piece 72 supported with respect to an upper end of the support piece 71 swingably about an axis along the second direction D2. The swing piece 72 has a distal end provided with an engagement shaft 73 engageable with a concave portion 41 formed in the pedal 40. The concave portion 41 is a concave groove which penetrates through the pedal 40 in the second direction D2 and has an opening oriented frontwardly in the first direction D1. The engagement shaft 73 extends along the second direction D2. When the swing piece 72 is swingably moved rearwardly, and the engagement shaft 73 is engaged with the concave portion 41, the pedal 40 is inoperably locked. On the other hand, when the swing piece 72 is swingably moved frontwardly, and the engagement shaft 73 is released from the concave portion 41, the pedal 40 becomes operable. The support piece 71 is formed with a third through-hole 71*a*. The support piece 71 is placed on the second extension portion 22*c* of the cover 22 in a state in which the third through-hole 71*a* is positioned to overlap the internal thread 83*d* (see FIG. 5). In this state, the support piece 71 is demountably mounted to the floor panel 7*a* by a screw bolt B screwed with the internal thread 83*d*.

As described above, in order to inoperably lock the pedal 40, it is necessary to insert the engagement shaft 73 of the stopper 70 into the concave portion 41 of the pedal 40 rearwardly from a front side of the pedal 40. Therefore, the stopper 70 and the pedal 40 have to be vertically positioned relative to each other. For this purpose, the stopper 70 and the remote control valve 30 are designed on an assumption that they are mounted on the same plane. In this situation, if the stopper 70 is directly mounted to the floor panel 7*a*, it is likely that the engagement shaft 73 cannot be adequately engaged with the concave portion 41 due to a deviation in height position corresponding to a thickness of the cover 22.

Thus, the cover 22 is provided with the second extension portion 22*c* extending to a mounting position of the stopper 70. The stopper 70 and the remote control valve 30 can be disposed on the same plane by placing the stopper 70 on the second extension portion 22*c*. In the predetermined mounting position of the stopper 70, the third through-hole 71*a* of the stopper 70, the second through-hole 22*d* of the second extension portion 22*c* and the internal thread 83*d* of the floor panel 7*a* overlap each other, so that it becomes possible to sharingly use a screw bolt B.

Figure 7:
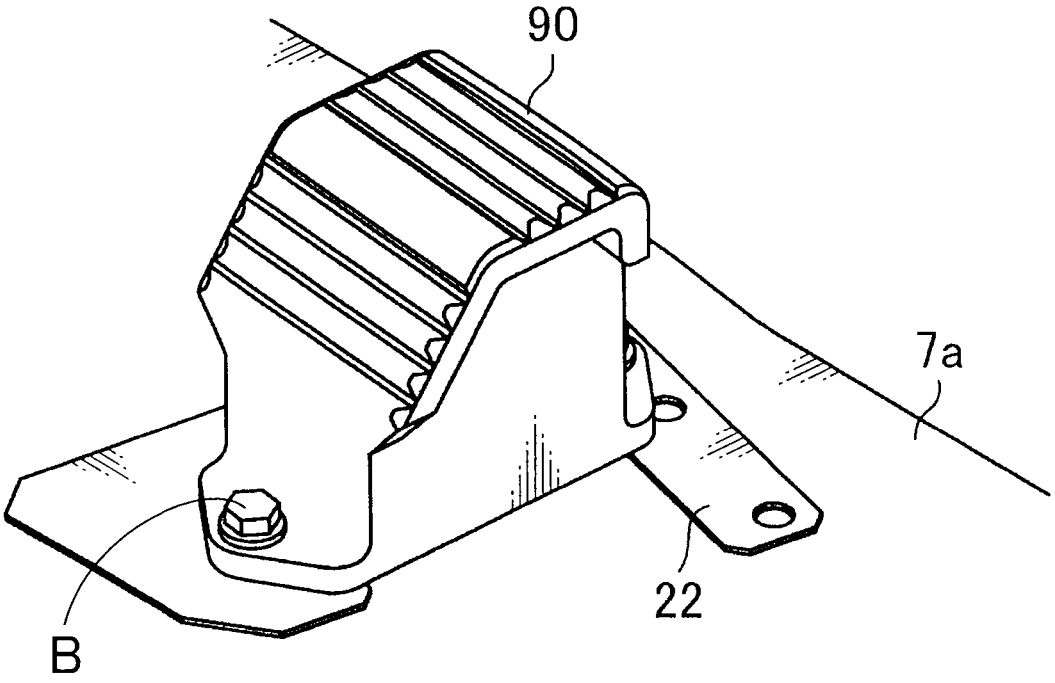
FIG. 7 is a schematic diagram illustrating a state in which the pedal device is replaced with a footrest.

As illustrated in FIG. 7, the machine body 3 in this embodiment comprises a footrest 90 adapted to be mountable to the floor panel 7*a*, under a condition that the pedal device 21 is demounted from the floor panel 7*a*. Specifically, as illustrated in FIG. 5, the footrest 90 is adapted to be mountable to the floor panel 7*a* in a position overlapping the arrangement region 81. The footrest 90 is also mounted to the floor panel 7*a* through the cover 22. The footrest 90 is mounted to the floor panel 7*a* by utilizing the internal thread 83*a* for mounting the pedal device 21. Specifically, the footrest 90 is provided with a through-hole (not illustrated) at a position overlapping the internal thread 83*a* of the floor panel 7*a* and the second through-hole 22*d* of the cover 22 in a state in which the footrest 90 is a predetermined mounting position. The footrest 90 and the cover 22 can be mounted to the floor panel 7*a* by screwing a screw bolt B inserted into the through-hole of the footrest 90 from thereabove, with the internal thread 83*a*.

As mentioned above, in the above embodiment, it is possible to minimize an opening area of the opening 95 formed in the floor panel 7*a* to mount, to the floor panel 7*a*, the pedal device 21 which comprises the valve body 32 having a cross-sectional shape in which the length L2 in the first direction D1 is greater than the length L1 in the second direction D2, in top plan view, and the joints 50 each having a portion extending in the first direction D1 and outwardly with respect to the valve body 32, in top plan view.

Specifically, in the above embodiment, the length L1 of the opening 95 in the second direction D2 is less than the length L2 of the opening 95 in the first direction D1, and the length L3 of the arrangement region 81 in the first direction D1 is less than the length L2 of the insertion region 82 in the first direction D1. In this manner, the length L2 of the insertion region 82 in the first direction D1 is largely ensured in conformity to the cross-sectional shape of the valve body 32 and the shape of each of the joints 50 in top plan view, so that the pedal device 21 can be mounted to the floor panel 7*a* from thereabove through the insertion region 82. In addition, the length L1 of the opening 95 in the second direction D2 is kept less than the length L2 of the opening 95 in the first direction D1, in conformity to the cross-sectional shape of the valve body 32, so that it becomes possible to minimize an opening area of the entire opening 95.

As above, in the above embodiment, a size of the opening 95 formed in the floor panel 7*a* can be kept small, so that it becomes possible to suppress deterioration in strength and rigidity of the floor panel 7*a*. In addition, the pedal device 21 can be mounted to the floor panel 7*a* by inserting the hydraulic hoses 60, the joints 50 and the valve body 32 into the insertion region 82 in sequence, in a state in which the hydraulic hoses 60 are preliminarily connected to the valve body 32 via the joints 50. Thus, in the above embodiment, it becomes possible to suppress deterioration in strength and rigidity of the floor panel 7*a*, while maintaining efficiency of a mounting operation for the pedal device 21.

For example, the insertion region 82 may be formed to have a size which does not allow the pedal device 21 to be inserted thereinto simply by being vertically moved downwardly in a mounting posture to be taken when it is mounted to the floor panel 7*a*, but allows the pedal device 21 to be inserted thereinto in a tilted posture where it is tilted from the mounting posture. In other words, in this case, the size of the insertion region 82 is less than a vertically projected shape of the valve body 32 and the joints 50 in the mounting posture, and greater than a vertically projected shape of the valve body 32 and the joints 50 in the tilted posture.

In the above embodiment, the flanges 33 can be mounted to the mounting portion 84 from above the floor panel 7*a*. This allows the pedal device 21 inserted into the insertion region 82 from above the floor panel 7*a* in the above manner to be mounted to the floor panel 7*a* from thereabove. Thus, in the above embodiment, a series of operations from insertion of the pedal device 21 into the opening 95 until mounting of the pedal device 21 to the floor panel 7*a* can be performed from above the floor panel 7*a*.

In the above embodiment, the mounting portion 84 is provided in the corner portion 96 adjacent the insertion region 82 and the arrangement region 81. This makes it possible to mount the pedal device 21 by utilizing the corner portion 96 formed by downsizing the arrangement region 81 in the first direction D1 so as to reduce an opening area of the opening 95.

In the above embodiment, the cover 22 can also be mounted to the floor panel 7*a* by utilizing the internal threads (screw threads) 83*a*, 83*b* and the screw bolts (screw members) B for mounting the pedal device 21 (flanges 33) to the floor panel 7*a*. This makes it possible to collectively mount the cover 22 and the pedal device 21 to the floor panel 7*a*, thereby providing enhanced efficiency of the mounting operation. Further, it becomes possible to reduce the number of components, thereby reducing component costs, as compared to the case where the internal threads 83*a*, 83*b* and the screw bolts B are provided in each of the pedal device 21 and the cover 22, separately.

In the above embodiment, the stopper 70 and the flanges 33 of the valve body 32 are mounted to the floor panel 7*a* in a state in which they are placed on the common cover 22. This allows respective positions of the stopper 70 and the valve body 32 to be accurately adjusted in terms of a predetermined height position for engagement therebetween. Thus, in the above embodiment, it becomes possible to reliably achieve the engagement between the stopper 70 and the pedal 40.

In the above embodiment, the machine body has the footrest 90 adapted to be mountable to the floor panel 7*a* in a position overlapping the arrangement region 81, under the condition that the pedal device 21 is demounted from the floor panel 7*a*. In other words, the pedal device 21 and the footrest 90 can be replaceably mounted in a predetermined position of the floor panel 7*a*. This makes it possible to perform the replacement between the pedal device 21 and the footrest 90, depending on specifications of the operating machine 1.

In the above embodiment, the pedal device 21 or the footrest 90 can be selectively mounted to the floor panel 7*a*. Therefore, it becomes possible to reduce the size of the opening 95, as compared to the conventional technique (JP 2005-264538A) designed such that the pedal device 21 and the footrest 90 are arranged in laterally side-by-side relation, while allowing a positional relationship between the pedal device 21 and the footrest 90 to be interchanged. Specifically, in the conventional technique, both of the pedal device and the footrest are arranged in laterally side-by-side relation within a predetermined range on the floor panel. Thus, two mounting positions for the pedal device are set depending on a width dimension of the footrest. In the conventional technique, the opening is formed in a range over the two mounting positions, so that an opening area of the opening is significantly large. Differently, in the above embodiment, it is only necessary to mount the pedal device 21 in one position of the floor panel 7*a*, so that it becomes possible to reduce an opening area of the opening 95 to be formed in the floor panel 7*a*.

In the above embodiment, the footrest 90 and the cover 22 can be mounted to the mounting portion 84 by screwing the internal thread 83*a* and the screw bolt (screw member) B with each other. This makes it possible to collectively mount the cover 22 and the foot rest 90 to the floor panel 7*a*, thereby providing enhanced efficiency of the mounting operation. Further, it becomes possible to reduce the number of components, thereby reducing component costs, as compared to the case where the internal thread 83*a* and the screw bolt B are provided in each of the cover 22 and the footrest 90, separately.

It is to be understood that the operating machine of the present invention is not limited to the above embodiment, but may encompass various other configurations.

For example, the above embodiment has been described by taking a recycling machine as an example. Alternatively, the present invention may be applied to a construction machine such as a hydraulic shovel. For example, in a so-called swing-type hydraulic shovel in which an attachment is supported swingably in a right-left direction, the present invention may be applied to a pedal for manipulating a swing movement of the attachment.

The above specific embodiment primarily includes the following invention.

The present invention provides an upper machine body to be provided on a lower propelling body of an operating machine. The upper machine body comprises: an attachment; a hydraulic actuator for driving the attachment by supply and drainage of hydraulic oil thereto and therefrom; a pedal device including a remote control valve for controlling the supply and drainage of hydraulic oil to and from the hydraulic actuator, a pedal and a joint each provided to the remote control valve, and a hydraulic hose connected to the joint; and a floor panel to which the pedal device is mounted, the floor panel being formed with an opening for permitting the remote control valve to penetrate through the floor panel in a posture where the pedal is disposed above the floor panel, and the joint and the hydraulic hose are disposed below the floor panel. The remote control valve has a valve body with a cross-sectional shape in which a length in a first direction is greater than a length in a second direction perpendicular to the first direction, in top plan view, and the joint has a portion extending in the first direction and outwardly with respect to the valve body, in top plan view. The opening of the floor panel has an insertion region configured to allow the joint, the hydraulic hose and a lower portion of the valve body to be inserted thereinto from above the floor panel, and an arrangement region located in side-by-side relation to the insertion region in the second direction and configured to allow the valve body to be arranged therein while being fixed to the floor panel. Further, in top plan view, a length of the opening in the second direction is less than a length of the opening in the first direction, and a length of the arrangement region in the first direction is less than a length of the insertion region in the first direction.

In the present invention, it is possible to minimize an opening area of the opening formed in the floor panel to mount, to the floor panel, the pedal device which comprises a valve body having a cross-sectional shape in which a length in a first direction is greater than a length in a second direction perpendicular to the first direction, in top plan view, and a joint having a portion extending in the first direction and outwardly with respect to the valve body, in top plan view.

Specifically, in the present invention, the length of the opening in the second direction is less than the length of the opening in the first direction, and the length of the arrangement region in the first direction is less than the length of the insertion region in the first direction. In this manner, the length of the insertion region in the first direction is largely ensured in conformity to the cross-sectional shape of the valve body and the shape of the joint in top plan view, so that the pedal device can be mounted to the floor panel from thereabove through the insertion region. In addition, the length of the opening in the second direction is kept less than the length of the opening in the first direction, in conformity to the cross-sectional shape of the valve body, so that it becomes possible to minimize an opening area of the entire opening.

As above, in the present invention, a size of the opening formed in the floor panel can be kept small, so that it becomes possible to suppress deterioration in strength and rigidity of the floor panel. In addition, the pedal device can be mounted to the floor panel by inserting the hydraulic hose, the joint and the valve body in sequence, in a state in which the hydraulic hose is preliminarily connected to the valve body via the joint. Thus, in the present invention, it becomes possible to suppress deterioration in strength and rigidity of the floor panel, while maintaining efficiency of a mounting operation for the pedal device.

For example, the insertion region may be formed to have a size which does not allow the pedal device to be inserted thereinto simply by being vertically moved downwardly in a mounting posture to be taken when it is mounted to the floor panel, but allows the pedal device to be inserted thereinto in a tilted posture where it is tilted from the mounting posture. In other words, in this case, the size of the insertion region is less than a vertically projected shape of the valve body and the joint in the mounting posture, and greater than a vertically projected shape of the valve body and the joint in the tilted posture.

Preferably, in the upper machine body of the present invention, the remote control valve has a flange protruding laterally from the valve body, and a mounting portion is provided in an edge of the arrangement region of the floor panel and is adapted to allow the flange to be mounted thereto from thereabove in a state in which the valve body is arranged in the arrangement region.

In this aspect, the flange can be mounted to the mounting portion from above the floor panel. This allows the pedal device inserted into the insertion region from above the floor panel in the above manner to be mounted to the floor panel from thereabove. Thus, in this aspect, a series of operations from insertion of the pedal device into the opening until mounting of the pedal device to the floor panel can be performed from above the floor panel.

Preferably, in the above upper machine body, the flange protrudes from the valve body in the first direction, and the mounting portion is provided in a corner portion of the floor panel adjacent the insertion region and the arrangement region.

In this aspect, the mounting portion is provided in the corner portion adjacent the insertion region and the arrangement region. This makes it possible to mount the pedal device by utilizing the corner portion formed by downsizing the arrangement region in the first direction so as to reduce an opening area of the opening.

Preferably, the above upper machine body further comprises a screw member capable of being screwed with a screw thread formed in the mounting portion of the floor panel, thereby allowing the flange to be mounted to the mounting portion, and a cover mounted to the floor panel to close the opening, wherein the screw thread and the screw member are adapted to be screwed with each other to allow the flange and the cover to be mounted to the mounting portion.

In this aspect, the cover can also be mounted to the floor panel by utilizing the screw thread and the screw member for mounting the pedal device (flange) to the floor panel. This makes it possible to collectively mount the cover and the pedal device to the floor panel, thereby providing enhanced efficiency of the mounting operation. Further, it becomes possible to reduce the number of components, thereby reducing component costs, as compared to the case where the screw thread and the screw member are provided in each of the pedal device and the cover, separately.

For example, a through-hole may be provided in the flange, and a threaded hole may be provided in the mounting portion. In this case, the pedal device can be mounted to the floor panel by driving a screw bolt into the threaded hole while penetratingly inserting the screw bolt into the through-hole.

Preferably, in the above upper machine body, the pedal device includes a stopper engageable with the pedal to preclude operation of the pedal, and the stopper and the flange of the valve body are mounted to the floor panel while being placed on the cover.

In this aspect, the stopper and the flange of the valve body are mounted to the floor panel in a state in which they are placed on the common cover. This allows respective positions of the stopper and the valve body to be accurately adjusted in terms of a predetermined height position for engagement therebetween. Thus, in this aspect, it becomes possible to reliably achieve the engagement between the stopper and the pedal.

Preferably, in the upper machine body of the present invention, the pedal device is adapted to be demountably mounted to the floor panel, and the upper machine body further comprises a footrest adapted to be mountable to the floor panel in a position overlapping the arrangement region, under a condition that the pedal device is demounted from the floor panel.

Preferably, in the above upper machine body, the pedal device is adapted to be demountably mounted to the floor panel, and the upper machine body further comprises a footrest adapted to be mountable to the floor panel in a position overlapping the arrangement region, under a condition that the pedal device is demounted from the floor panel, and the screw thread and the screw member are adapted to be screwed with each other to allow the footrest and the cover to be mounted to the mounting portion.

In these aspects, the upper machine body has the footrest adapted to be mountable to the floor panel in a position overlapping the arrangement region, under the condition that the pedal device is demounted from the floor panel. In other words, the pedal device and the footrest can be replaceably mounted in a predetermined position of the floor panel. This makes it possible to perform the replacement between the pedal device and the footrest, depending on specifications of an operating machine.

In these aspects, the pedal device or the footrest can be selectively mounted to the floor panel. Therefore, it becomes possible to reduce a size of the opening, as compared to the conventional technique (JP 2005-264538A) designed such that a pedal device and a footrest are arranged in laterally side-by-side relation, while allowing a positional relationship between the pedal device and the footrest to be interchanged. Specifically, in the conventional technique, both of the pedal device and the footrest are arranged in laterally side-by-side relation within a predetermined range on the floor panel. Thus, two mounting positions for the pedal device are set depending on a width dimension of the footrest. In the conventional technique, the opening is formed in a range over the two mounting positions, so that an opening area of the opening is significantly large. Differently, in these aspect, it is only necessary to mount the pedal device in one position of the floor panel, so that it becomes possible to reduce an opening area of the opening to be formed in the floor panel.

In case where the footrest and the cover can be mounted to the mounting portion by screwing the screw thread and the screw member with each other, so that it becomes possible to collectively mount the cover and the foot rest to the floor panel, thereby providing enhanced efficiency of the mounting operation. Further, it becomes possible to reduce the number of components, thereby reducing component costs, as compared to the case where the screw thread and the screw member are provided in each of the cover and the footrest, separately.

The present invention also provides an operating machine which comprises a self-propelled lower propelling body, and the above upper machine body provided on the lower propelling body.

This application is based on Japanese Patent application No. 2011-227609 filed in Japan Patent Office on Oct. 17, 2011, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. An upper machine body to be provided on a lower propelling body of an operating machine, comprising:

an attachment;

a hydraulic actuator for driving the attachment by supply and drainage of hydraulic oil thereto and therefrom;

a pedal device including a remote control valve for controlling the supply and drainage of hydraulic oil to and from the hydraulic actuator, a pedal and a joint each provided to the remote control valve, and a hydraulic hose connected to the joint; and a floor panel to which the pedal device is mounted, the floor panel being formed with an opening for permitting the remote control valve to penetrate through the floor panel in a posture where the pedal is disposed above the floor panel, and the joint and the hydraulic hose are disposed below the floor panel, wherein:

the remote control valve has a valve body with a cross-sectional shape in which a length in a first direction is greater than a length in a second direction perpendicular to the first direction, in top plan view;

the joint has a portion extending in the first direction and outwardly with respect to the valve body, in top plan view; and the opening of the floor panel has an insertion region configured to allow the joint, the hydraulic hose and a lower portion of the valve body to be inserted thereinto from above the floor panel, and an arrangement region located in side-by-side relation to the insertion region in the second direction and configured to allow the valve body to be arranged therein while being fixed to the floor panel, and wherein, in top plan view, a length of the opening in the second direction is less than a length of the opening in the first direction, and a length of the arrangement region in the first direction is less than a length of the insertion region in the first direction.

2. The upper machine body according to claim 1, wherein:

the remote control valve has a flange protruding laterally from the valve body; and a mounting portion is provided in an edge of the arrangement region of the floor panel and is adapted to allow the flange to be mounted thereto from thereabove in a state in which the valve body is arranged in the arrangement region.

3. The upper machine body according to claim 2, wherein:

the flange protrudes from the valve body in the first direction; and the mounting portion is provided in a corner portion of the floor panel adjacent the insertion region and the arrangement region.

4. The upper machine body according to claim 2, further comprising:

a screw member capable of being screwed with a screw thread formed in the mounting portion of the floor panel, thereby allowing the flange to be mounted to the mounting portion; and a cover mounted to the floor panel to close the opening, wherein the screw thread and the screw member are adapted to be screwed with each other to allow the flange and the cover to be mounted to the mounting portion.

5. The upper machine body according to claim 4, wherein:

the pedal device includes a stopper engageable with the pedal to preclude operation of the pedal; and the stopper and the flange of the valve body are mounted to the floor panel while being placed on the cover.

6. The upper machine body as defined in claim 4, wherein:

the pedal device is adapted to be demountably mounted to the floor panel;

the upper machine body further comprises a footrest adapted to be mountable to the floor panel in a position overlapping the arrangement region, under a condition that the pedal device is demounted from the floor panel; and the screw thread and the screw member are adapted to be screwed with each other to allow the footrest and the cover to be mounted to the mounting portion.

7. The upper machine body according to claim 1, wherein:

the pedal device is adapted to be demountably mounted to the floor panel; and the upper machine body further comprises a footrest adapted to be mountable to the floor panel in a position overlapping the arrangement region, under a condition that the pedal device is demounted from the floor panel.

8. An operating machine comprising a self-propelled lower propelling body, and the upper machine body according to claim 1, the upper machine body being provided on the lower propelling body.

* * * * *